US007793595B2

(12) United States Patent
Fortuna

(10) Patent No.: US 7,793,595 B2
(45) **Date of Patent: *Sep. 14, 2010**

(54) RAILCAR GATE ASSEMBLY OPERATING SHAFT ASSEMBLY

(75) Inventor: Rudoplh S. Fortuna, Oak Creek, WI (US)

(73) Assignees: Miner Enterprises, Inc., Geneva, IL (US); Powerbrace Corporation, Kenosha, WI (US)

( * ) Notice: Subject to any disclaimer, the term of this patent is extended or adjusted under 35 U.S.C. 154(b) by 1298 days.

This patent is subject to a terminal disclaimer.

(21) Appl. No.: 11/255,316

(22) Filed: Oct. 21, 2005

(65) Prior Publication Data

US 2007/0089639 A1 Apr. 26, 2007

(51) Int. Cl.
*B61D 7/20* (2006.01)
*B61D 7/24* (2006.01)

(52) U.S. Cl. ..... 105/282.3; 105/282.1; 105/305

(58) Field of Classification Search ..... 105/282.1–289, 105/294, 305

See application file for complete search history.

(56) References Cited

U.S. PATENT DOCUMENTS 4,342,267 A * 8/1982 Blout ..... 105/282.2
5,353,713 A 10/1994 Dohr et al.
5,584,251 A * 12/1996 Lucas ..... 105/305
5,829,359 A 11/1998 Dohr et al.
7,497,170 B2 * 3/2009 Fortuna et al. ..... 105/286

* cited by examiner

*Primary Examiner*—S. Joseph Morano
*Assistant Examiner*—Zachary Kuhfuss
(74) *Attorney, Agent, or Firm*—Law Office of John W. Harbst

(57) ABSTRACT

A railcar operating shaft assembly mounted on a gate assembly frame for moving a gate between closed and open positions. The operating shaft assembly includes an operating shaft and a capstan assembly provided at each end of the operating shaft. Each capstan assembly includes first and second axially aligned and conjoined but separate members. The first member is releasably coupled in non-rotatable relation relative to a free end of the operating shaft and is mountable on the gate assembly frame for rotation about a fixed axis. The second member of each capstan assembly is releasably conjoined in non-rotatable relation relative to the first member such that rotational movements imparted to the second member are transferred to the first member and to the operating shaft coupled thereto. The second member of each capstan assembly has a free end portion configured with a plurality of surfaces flanking the fixed axis of rotation of the first member and at least two of which are releasably engaged by a mechanized device used to forcibly impart rotation to the operating shaft assembly.

29 Claims, 5 Drawing Sheets

RAILCAR GATE ASSEMBLY OPERATING SHAFT ASSEMBLY

FIELD OF THE INVENTION

The present invention disclosure generally relates to railcar gate assemblies and, more specifically, to an operating shaft assembly for operating a gate assembly on a railcar.

BACKGROUND OF THE INVENTION

Railroad hopper cars are used to economically transport commodities between distantly spaced geographic locations. Granular commodities, i.e., corn, grain and etc., can be rapidly discharged from the hopper car through gate assemblies mounted in material receiving relation relative to standard discharge openings on a bottom of the hopper car. Each gate assembly typically includes a rigid frame connected to the bottom of the hopper car and defining a discharge opening. A gate is slidably movable on the gate assembly frame for controlling the discharge of commodity through the discharge opening. An operating shaft assembly is also mounted on the frame in operable combination with and for moving the gate between closed and open positions.

A typical operating shaft assembly typically includes an elongated shaft supported at opposite ends for rotation about a fixed axis by operating handles which are sometimes referred to as capstans. Each capstan or operating handle is operably connected in nonrotatable relation relative to each end of the operating shaft and is journalled for rotation by an extension on the gate assembly frame. Each capstan has an axially elongated configuration which is unitary or of one-piece construction and often has a generally hollow end exposed to the side of the railcar.

That is, a free end of a conventional capstan is configured to allow an elongated opening bar to be passed through aligned slots on opposed sides of an elongated axis, about which the capstan turns, and further includes a generally square socket for accommodating a drive spindle of a mechanical opener. Their size and shape is not conducive to casting a capstan from steel. Accordingly, a typical capstan is made from cast iron. As known, cast iron also has wear and lubricity advantages over a similar steel part.

Once a hopper car reaches an unloading site, the gate is slid open and gravity causes the commodity within the hopper car to readily flow therefrom. As will be appreciated by those skilled in the art, the commodity within the car exerts a relatively large columnar load on an upper surface of a closed gate. Such downward load on the gate has caused and continues to cause a significant problem in manual opening of the gate at the unloading site. Of course, at the unloading site, time is of the essence and any complications involving opening of the discharge gate to unload the commodity presents serious concerns.

Since the time involved with unloading of the hopper car has become a paramount concern, mechanized gate openers are becoming more common. These mechanical openers, however, are much more abusive to the operating handles or capstans than when an elongated bar is used to manually open the gate. With a mechanical opener, a drive spindle is inserted into and engages the marginal edges of the generally square socket on the capstan to transmit opening torque to the operating shaft assembly. The drive spindle on such mechanical drivers usually includes a guide at the free end of the spindle for guiding the drive spindle into the square opening at the free end of the capstan.

Unless the mechanical opener is operated with care, however, the drive spindle is frequently engaged and turning when it is initially inserted into the square opening in the capstan. The high speed turning or rotating movement of the drive spindle relative to the stationary capstan frequently acts to wear against the marginal edges of the square opening in the capstan. Moreover, and because of the relatively large columnar loading placed on the gate by the commodity within the car, the drive spindle of the mechanical opener frequently slips within the square socket opening defined by the capstan, especially at the onset of the gate opening movements. Additionally, the railcar gate assembly is frequently provided with solid stops for limiting fore-and-aft movements of the gate. After the gate reaches either stop, continuing rotation of the drive spindle of the mechanical opener within the now stopped capstan often results in further wear to the square shaped opening in the capstan.

As known, relative movement between the drive spindle of the mechanical opener and the square socket opening defined by the capstan, regardless of the reason, tends to cause the marginal edges of the square socket opening defined by the capstan to rapidly wear and eventually become circular rather than square in shape. Of course, the more wear imparted to the capstan, greater is the loss in the ability to transmit torque to the operating shaft assembly to thus affect timely opening of the gate.

Presently known solutions to a worn opening on the capstan involves either welding a flat plate with a square hole or opening therein to the free end of the capstan or replacement of the entire capstan. Each proposal has serious drawbacks. First, welding a plate with a square hole therein to a cast iron capstan does not usually produce a strong weld. Thus, the plate must be of a low alloy to allow any sort of welding to the cast iron capstan to be successful. Because the plate is of a low alloy, however, the marginal edges of the square hole in the plate become quickly worn by the drive spindle and the above-mentioned torque requirements. Second, welding a low alloy plate to the capstan requires the railcar having the worn capstans to be taken out of rail service. Third, welding a low alloy plate to the worn capstan requires an experienced and skilled welder. Suffice it to say, welding a plate to the worn capstan is time consuming and is not logistically or financially prudent.

Replacing a worn capstan is likewise time consuming since the railcar again needs to removed and taken out from rail service to affect such replacement. After removing the railcar with the worn capstan from service, considerable time is typically spent disconnecting the worn capstan from the operating shaft followed by the reassembly of the new capstan to the operating shaft. As will be readily appreciated, replacing a worn capstan is expensive as comparted to welding a plate to the free end of the capstan. Removing the capstans from the operating shaft frequently results in inadvertent separation of the operable drive connection between the operating shaft and gate. As such, when the capstans are removed from the operating shaft assembly, the timing relationship between the operating shaft assembly and gate movement can also be adversely affected.

Thus, there is a need and continuing desire for a quick and economical solution to the heretofore known problems associated with worn operating handles or capstans on a railcar operating shaft assembly.

SUMMARY OF THE INVENTION

According to one aspect, there is provided a railcar gate assembly operating shaft assembly mountable for rotation on a railcar gate assembly and operably coupled to a gate mounted on a frame for movement between closed and open positions in response to rotation of the operating shaft assembly. The operating shaft assembly includes an operating shaft and a capstan assembly provided at each end of the operating shaft. Each capstan assembly includes a first member releasably coupled in non-rotatable relation relative to a free end of the operating shaft and mountable on the gate assembly frame for rotation about a fixed axis. Each capstan assembly further includes a second member releasably coupled in non-rotatable relation relative to an end of the first member, opposite from the operating shaft, such that rotational movements imparted to the second member are transferred to the first member and to the operating shaft coupled thereto. The second member has an enlarged head portion defining an opening which is axially aligned with the fixed axis of rotation of the first member. The opening defined by the head portion of the second member has a closed and non-circular marginal edge extending axially inward from the terminal end of the second member for releasably accommodating a drive spindle of a mechanical opener.

In one form, the operating shaft has a non-circular solid cross-sectional configuration extending substantially between opposed ends thereof. Preferably, the first member is provided with a cavity axially aligned with the fixed axis of rotation of the first member. The cavity in the first member opens that end of the first member opposite from the end connected to the second member. In one form, the cavity in the first member has a non-circular and closed marginal edge configured substantially similar to that of the operating shaft. In one form, a fastener releasably couples the first member and the operating shaft in operable relation relative to each other. In a most preferred form, the first member is provided with cam structure . Moreover, in a preferred embodiment, that end of the first member connected to the second member has a non-circular cross-sectional configuration extending axially inward from a terminal end thereof In one form, the second member of each capstan assembly is provided with a cavity opening to that end adapted to be arranged axially adjacent to the terminal end of the first member. The cavity defined by the second member has a closed and non-circular marginal edge substantially similar to the non-circular cross-sectional configuration extending axially inward from the terminal end of the first member. Moreover, the head portion on the second member preferably defines two pairs of openings passing therethrough. Each pair of openings preferably has a closed marginal edge and is disposed in generally normal relation relative to the other pair of openings. Additionally, each pair of openings is preferably disposed along an axis extending generally normal to the fixed axis of rotation of said the member. To operably connect the operating shaft assembly to the gate, a pair of substantially identical pinion gears are preferably mounted on the operating shaft.

According to another aspect, there is provided a multipiece operating shaft assembly mountable for rotation by frame members of a railcar gate frame assembly. The frame members of the gate assembly used to mount the operating shaft assembly are laterally separated by a predetermined distance. The operating shaft assembly is operably coupled to a gate mounted on the frame for movement between closed and open positions in response to rotation of the operating shaft assembly. According to this aspect, the multipiece operating shaft assembly includes an operating shaft having two ends. A distance between the ends of the operating shaft is greater than the predetermined distance separating the frame members used to mount the operating shaft assembly. The operating shaft assembly also includes a capstan assembly provided at each end of the operating shaft. Each capstan assembly includes an axially elongated driven member having first and second axially aligned ends. The first end of the driven member is releasably coupled in non-rotatable relation relative to one end of the operating shaft. The driven member is configured with a hub bearing portion arranged adjacent to the first end of the driven member for journaling the driven member on one of the frame members of the gate assembly for rotation about a fixed axis. Each capstan assembly further includes an axially elongated drive member having first and second ends. The first end of the drive member is configured to be releasably coupled in non-rotatable relation relative to the second end of the driven member such that rotational movements imparted to the drive member are transferred to the driven member and to the operating shaft. The second end of the drive member is configured with a head portion defining a recess which is axially aligned with the fixed axis of rotation of and opens to the second end of the driven member. The recess in the drive member has a non-circular and closed marginal edge extending axially inward from the second end of the drive member for releasably accommodating a drive spindle of a mechanical opener.

Preferably, the driven and drive members of each capstan assembly are formed as a result of a casting process. In one form, the operating shaft has a non-circular solid cross-sectional configuration extending substantially between opposed ends thereof. In a preferred embodiment, the driven member defines a cavity axially aligned with the fixed axis of rotation of the drive member. The cavity defined by the driven member opens to the first end and preferably has a closed non-circular marginal edge configuration substantially similar to that of the operating shaft. Preferably, a fastener releasably couples the driven member and the operating shaft in operable relation relative to each other. Moreover, in one embodiment, the driven member is provided with cam structure between the axially aligned ends thereof In one form, the second end of the driven member has a non-circular cross-sectional configuration extending axially inward from a terminal end portion thereof.

In one form, the drive member defines a cavity opening to the first end thereof. The cavity defined by the drive member has a closed marginal edge which is preferably non-circular and is substantially similar to that non-circular cross-sectional configuration at the second end of the driven member. Moreover, the head portion on the driven member preferably defines two pairs of openings passing therethrough. Each pair of openings has a closed marginal edge and is disposed in generally normal relation relative to the other. Preferably, each pair of openings is disposed along an axis extending generally normal to the fixed axis of rotation of the drive member. To operably connect the operating shaft assembly to the gate, a pair of substantially identical pinion gears are preferably mounted on the operating shaft.

According to another aspect, there is provided a multipiece operating shaft assembly mountable for rotation on a railcar gate assembly and operably coupled to a gate mounted on a frame for movement between closed and open positions in response to rotation of the operating shaft assembly. The multipiece operating shaft assembly includes an elongated operating shaft and a capstan assembly provided at each end of the operating shaft. Each capstan assembly includes a first and second axially aligned and conjoined but separate members. The first member is releasably coupled in non-rotatable relation relative to a free end of the operating shaft and is mountable on the gate assembly frame for rotation about a fixed axis. The second member of each capstan assembly is releasably conjoined in non-rotatable relation relative to the first member such that rotational movements imparted to the second member are transferred to the first member and to the operating shaft coupled thereto. The second member of each capstan assembly has a free end portion configured with a plurality of surfaces flanking the fixed axis of rotation of the first member and at least two of which are releasably engaged by a mechanized device used to forcibly impart rotation to the operating shaft assembly.

Preferably, the second member of each capstan assembly defines a bore opening to one end of the second member. The bore is preferably axially aligned with the fixed axis about which the second member rotates. Moreover, the bore defined at the end of the second member preferably has a closed and non-circular marginal edge defining those surfaces releasably engaged by said mechanized device.

In a preferred form, the operating shaft has a non-circular cross-sectional configuration extending substantially between opposed ends thereof. Moreover, the first member of each capstan assembly is preferably provided with a recess axially aligned with the fixed axis of rotation of the first member. The recess in the first member preferably opens to an end connectable to the operating shaft. In one form, the recess in the first member preferably has a closed marginal edge with a non-circular configuration substantially similar to that of the operating shaft. Preferably, a fastener releasably maintains the first member and the operating shaft in operable combination relative to each other. In one form, the first member has a non-circular cross-sectional configuration extending axially inward from the free end thereof.

Preferably, the second member of each capstan assembly is provided with a recess opening to an end of the second member opposite from that end engagable by the mechanized driver. The recess defined by the second member of each capstan assembly preferably has a closed marginal edge which is non-circular and is configured substantially similar to the non-circular cross-sectional configuration extending axially inward from the end of the first member. In one form, the second member defines, toward the free end portion thereof, two pairs of openings passing therethrough. Each pair of openings preferably has a closed marginal edge and is disposed in generally normal relation relative to the other. Moreover, each pair of openings is preferably disposed along an axis extending generally normal to the fixed axis of rotation of the first member. To operably connect the operating shaft assembly to the gate, a pair of substantially identical pinion gears are preferably mounted on the operating shaft.

One feature of this invention disclosure relates to providing an operating shaft assembly for a railcar gate assembly, wherein the operating shaft assembly includes a capstan assembly at each end of an operating shaft, and wherein each capstan assembly comprises at least two operably interconnected components allowing for quick and ready repair/replacement of only that capstan assembly component which becomes worn or damaged from use of a mechanized driver.

Another feature of this invention disclosure relates to providing an operating shaft assembly for a railcar gate assembly and which includes an operating shaft having a capstan assembly at each end thereof, and wherein each capstan assembly includes replaceable parts which can be fabricated from different materials, are simple to manufacture, and can be reasonably priced.

Still another feature of this invention disclosure relates to the provision of an operating shaft assembly for a railcar gate assembly and which includes an elongated operating shaft having a capstan assembly at each end thereof, and wherein each capstan assembly includes replaceable parts at a distal end thereof so as to readily allow a worn part on the capstan to be readily replaced without requiring the entire car to be removed from service.

These and other features, objects aims and advantages of the present invention disclosure will become more readily apparent from the following detailed description, the drawings, and the appended claim program.

DETAILED DESCRIPTION OF THE INVENTION

Figure 1:
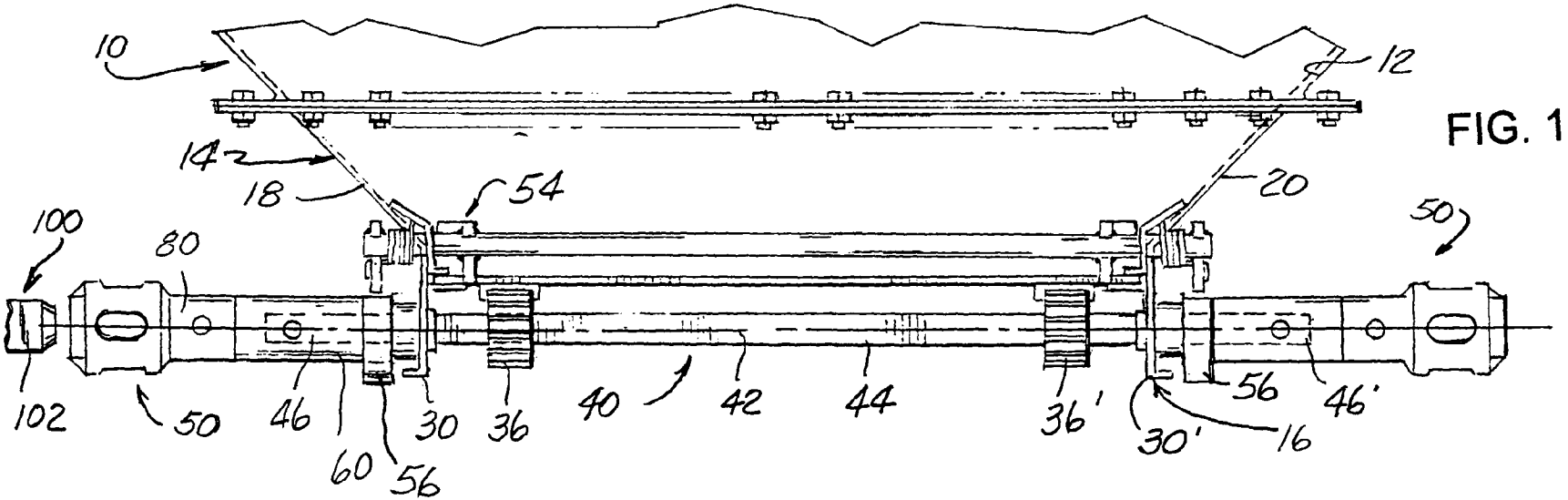
FIG. 1 is a rear elevational view of a railroad hopper car discharge gate assembly with an operating shaft assembly embodying features of the present invention disclosure.

While the present invention disclosure is susceptible of embodiment in multiple forms, there is shown in the drawings and will hereinafter be described a preferred embodiment of the invention disclosure, with the understanding the present disclosure sets forth an exemplification which is not intended to limit the invention disclosure to the specific embodiment illustrated and described.

Referring now to the drawings, wherein like reference numerals indicate like parts throughout the several views, there is shown in FIG. 1 a railroad hopper car, generally indicated by reference numeral 10. As is conventional, the railcar 10 is schematically illustrated as including an outlet 12 which opens to the bottom of the car 10. Typically, the hopper car 10 has more than one outlet provided thereon. Since the outlets are all substantially the same, however, only one outlet is shown for purposes of this description.

To control the discharge of commodity from the outlet, a discharge gate assembly 14 is arranged in operable combination with each railcar outlet 12. The railcar gate assembly 14 includes a rigid frame assembly 16 formed of respective opposed sides 18, 20 (FIG. 1) and opposed ends 22, 24 (FIG. 2) which combine to define a discharge opening 26 (FIG. 3) therebetween, In the gate assembly illustrated, and toward their lower ends, the sides 18, 20 and ends 22, 24 each define common support structure upon which a door or gate 28 is mounted for sliding movement between open and closed positions.

Projecting away from end 24 and extending lengthwise of the railcar 10, frame assembly 16 further includes generally parallel frame extensions 30, 30'. As shown in FIG. 1, the frame extensions 30, 30' are laterally separated by a predetermined distance and serve to support the gate 28 when it is moved to an open position.

Figure 2:
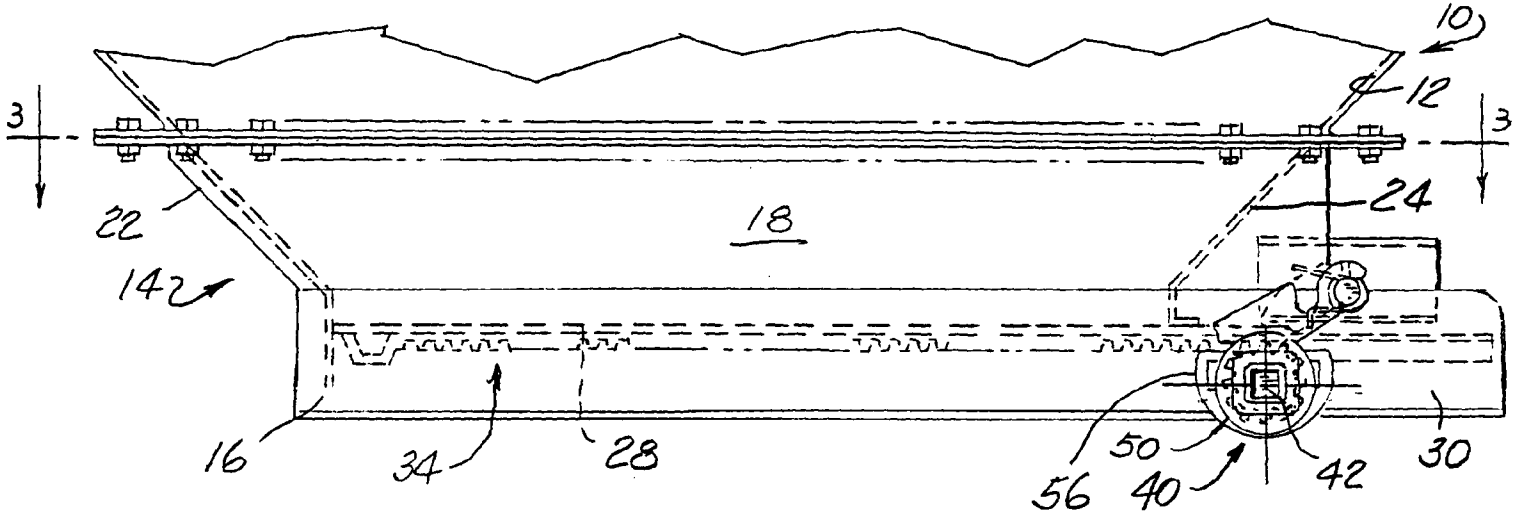
FIG. 2 is a side elevational view of the gate assembly shown in FIG. 1.
Figure 3:
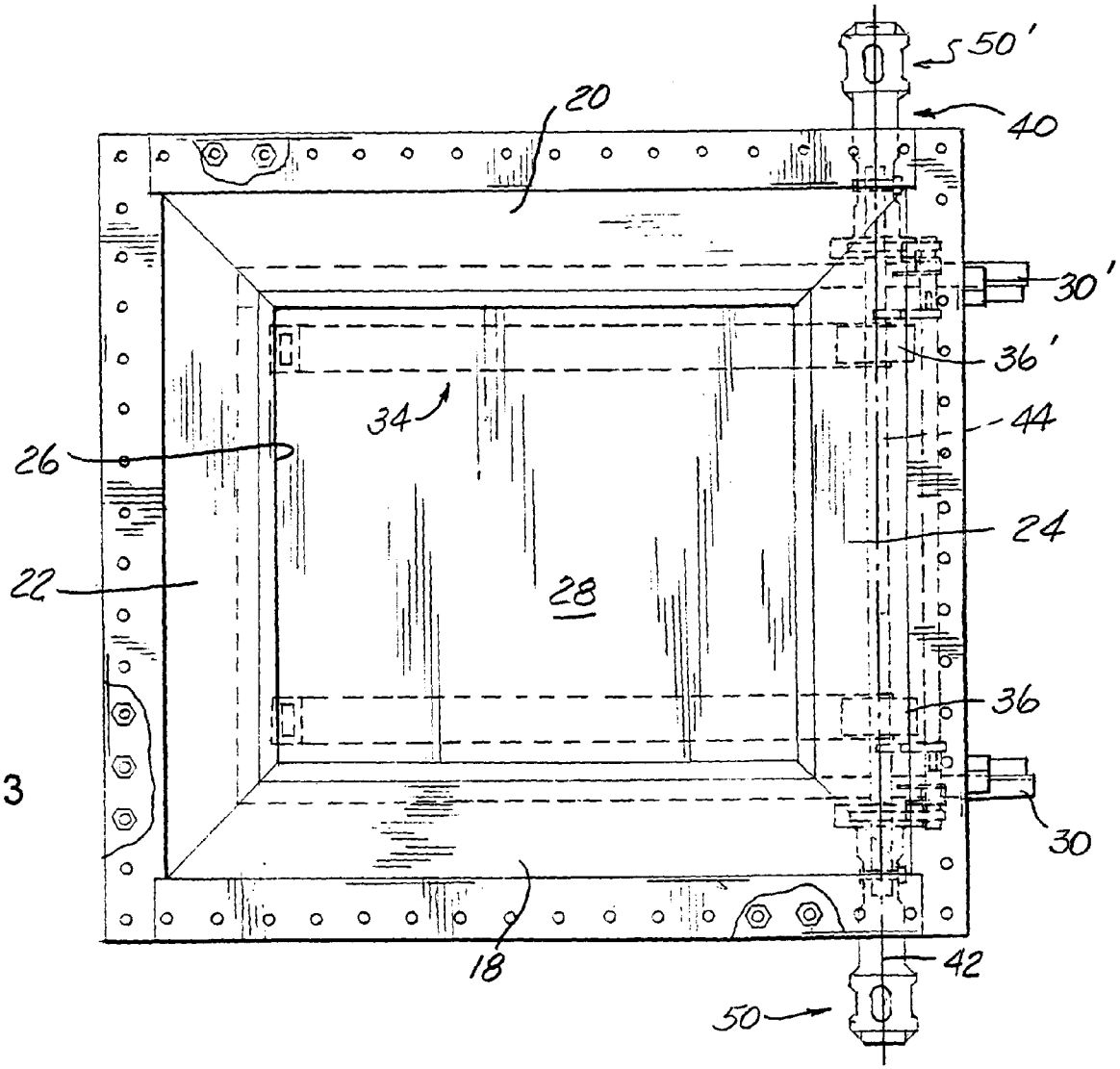
FIG. 3 is a top plan view taken along line 3-3 of FIG. 2.

As shown in FIGS. 1 through 3, gate assembly 14 further includes an operating shaft assembly 40 mounted for rotation about a fixed axis 42. As is known, the operating shaft assembly 40 is mounted for rotation by the frame extensions 30, 30'. The operating shaft assembly 40 is operably coupled to the gate 28 such that gate 28 linearly moves between open and closed positions in response to rotation of the operating shaft assembly 40 about axis 42.

In the embodiment illustrated in FIGS. 1 through 3, operating shaft assembly 40 extends transversely across the longitudinal axis of the railcar 10 and beneath the gate 28. It should be appreciated, however, the operating haft assembly 40 can be otherwise arranged relative to the gate assembly 14 without departing or detracting from the spirit and scope of this invention disclosure.

According to this invention disclosure, and as shown in FIG. 1, the operating shaft assembly 40 includes an elongated operating shaft 44 having opposed ends 46 and 46'. In one form, the distance between the ends 46, 46' of the operating shaft 44 is greater than the predetermined distance laterally separating the frame extensions 30 and 30'. As shown, each end 46 and 46' of the operating shaft 44 has an operating handle or capstan assembly 50 and 50', respectively, operably coupled thereto. The capstans assemblies 50, 50' arranged at the ends 46, 46' of the operating shaft 40 serve to rotatably mount the operating shaft assembly 40 to the frame extensions 30, 30' in a conventional manner.

Figure 4:
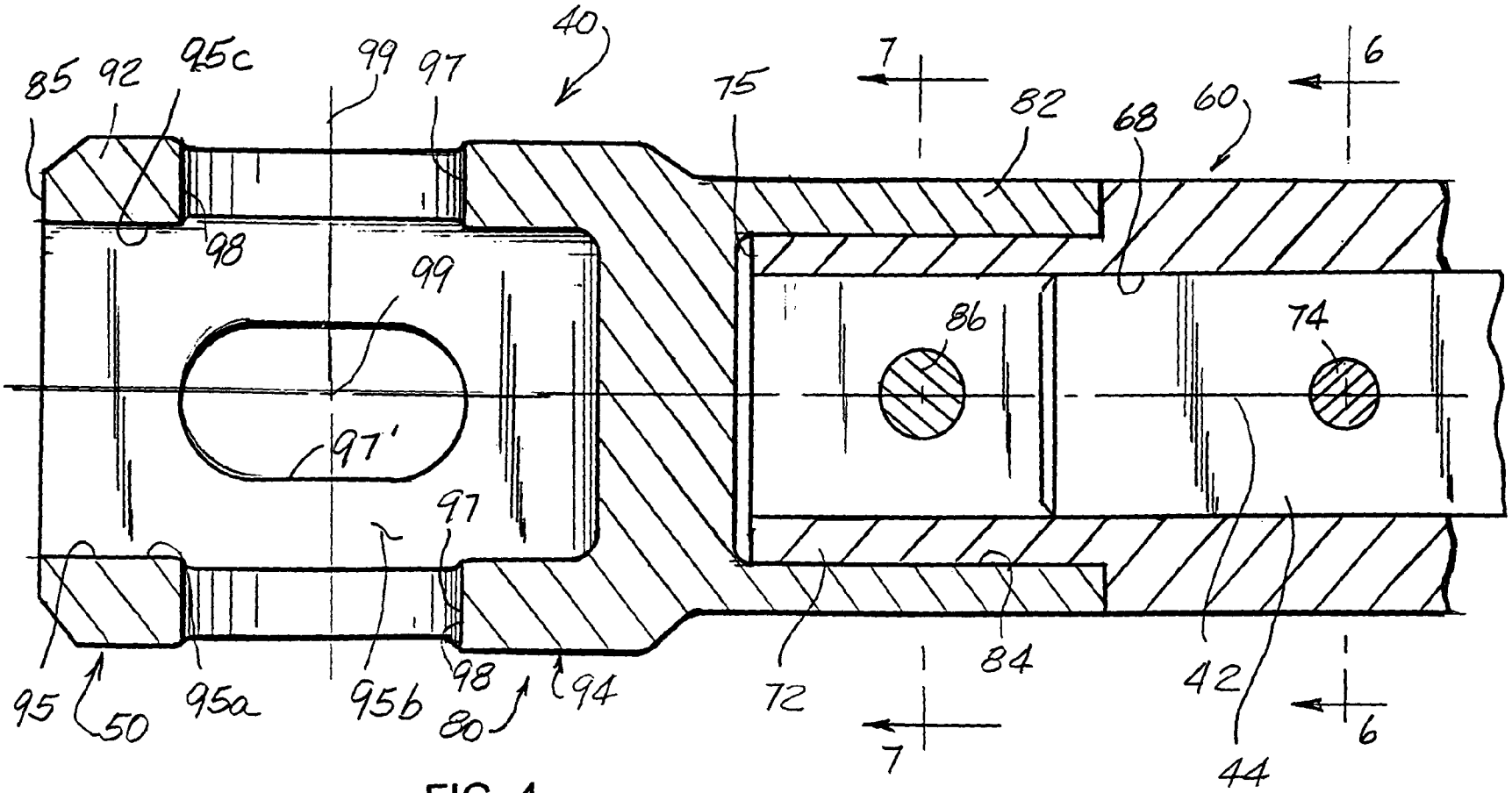
FIG. 4 is a perspective view of various components of and disposed toward one end of an operating shaft assembly embodying features of the present invention disclosure in disassembled relation relative to each other.

The capstan assemblies 50, 50' arranged at the ends of the operating shaft 44 are substantially mirror images of each other. Accordingly, only capstan assembly 50 will be discussed in detail while providing an understanding of both assemblies 50 and 50'. As shown in FIGS. 1 and 4, each capstan assembly includes an axially elongated first or driven member 60 and a separate but conjoined and axially elongated second or drive member 80. In the embodiment illustrated, the first and second members 60 and 80, respectively, forming each capstan assembly are axially aligned relative to each other. As shown in FIG. 4, the first member 60 of each capstan assembly has first and second axially aligned ends 62 and 72, respectively. A hub bearing portion 66 is arranged adjacent to the first end 62 of the first member 60. The hub bearing portion 66 serves to journal the driven member 60 on one of said frame extensions 30, 30' (FIG. 1) of the gate assembly frame 16 for rotation about the fixed axis 42.

Besides being mounted on the gate assembly frame 16 for rotation about the fixed axis 42, the first or driven member 60 of each capstan assembly is releasably coupled in non-rotatable relation relative to one end of the operating shaft 44. In that embodiment shown in FIGS. 1, 4 through 6, the operating shaft 44 has a non-circular and preferably solid cross-sectional configuration extending substantially the length between ends 46, 46'. The non-circular cross-sectional configuration of shaft 44 is shown, by way of example, as being square. Given an understanding of this invention disclosure, it will be appreciated that the non-circular cross-sectional configuration of shaft 44 could likewise be oval, rounded triangle, or spline (along the long axis of shaft 44) without detracting or departing from the spirt and scope of the invention disclosure.

Figure 5:
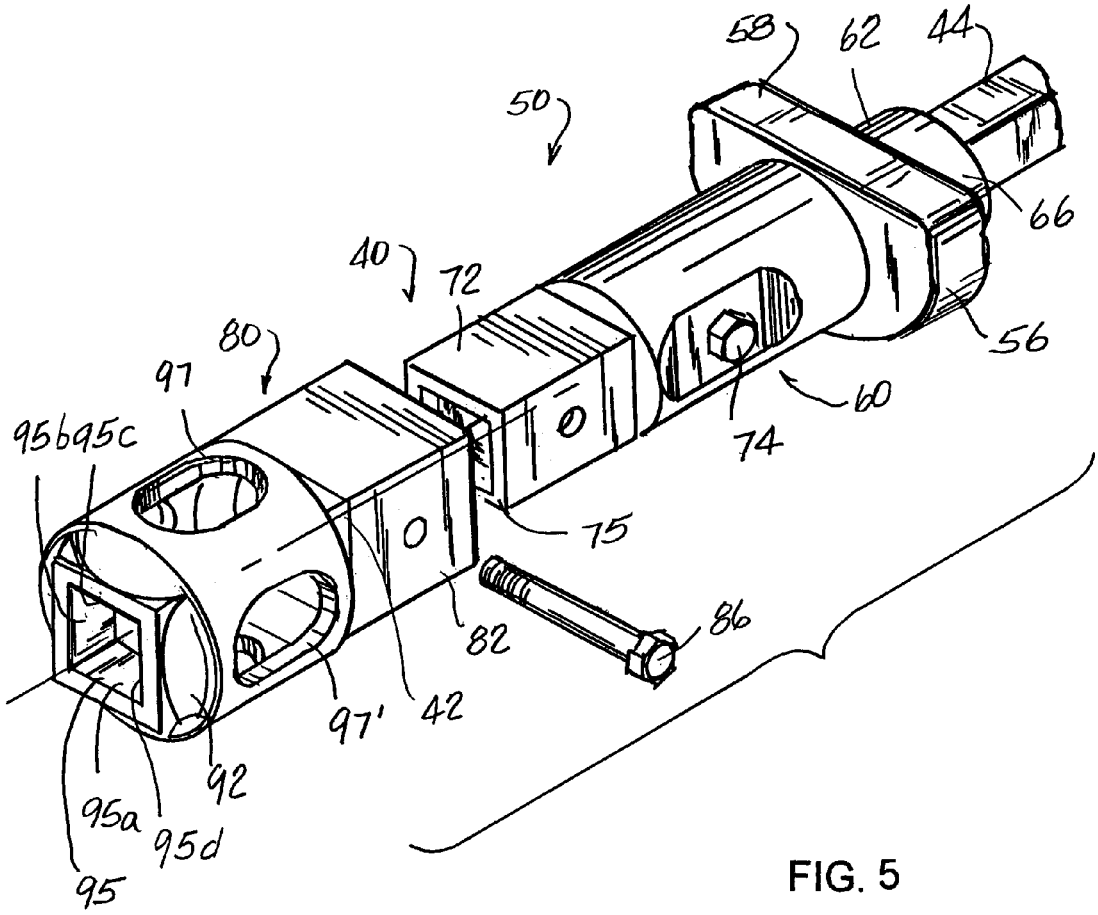
FIG. 5 is a fragmentary enlarged longitudinal sectional view of one end of the an operating shaft assembly embodying features of the present invention disclosure.
Figure 6:
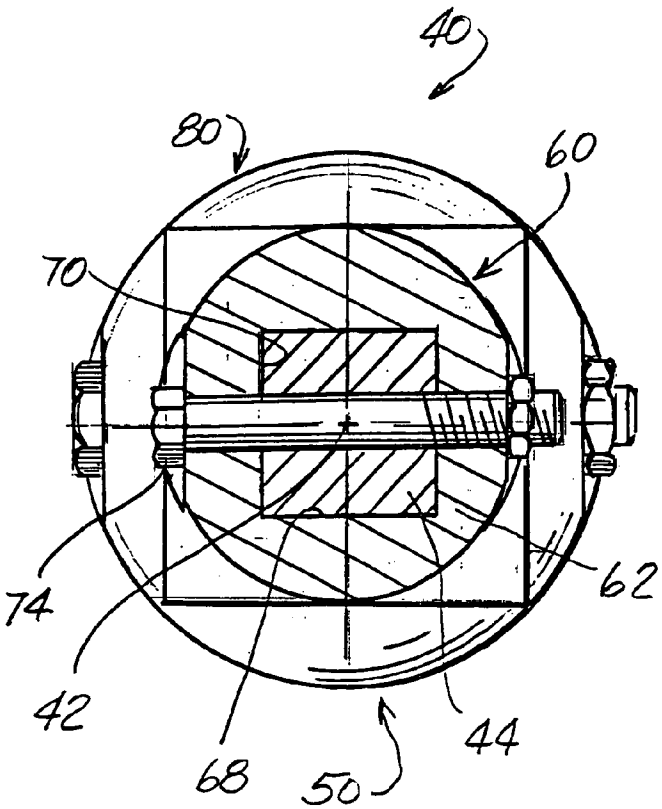
FIG. 6 is a sectional view taken along line 6-6 of FIG. 5.

Turning to the embodiment illustrated in FIGS. 5 and 6, the first or driven member 60 of each capstan assembly further defines a cavity or recess 68 which is axially aligned with the fixed axis 42 about which member 60 turns. As shown in FIG. 5, recess 68 opens to end 62 of member 60 so as to allow for reception and accommodation of one end 46, 46' of the operating shaft 44. The recess 68 has a closed and non-circular marginal edge configuration 70 substantially similar to that of the operating shaft 44. The closed and non-circular marginal edge 70 of cavity 68 is configured to allow one end of shaft 44 to be longitudinally received therewithin while preventing rotation or rotary movement between member 60 and shaft 44 when drive member 60 is turned or rotated about axis 42.

After drive member 60 arranged is operable combination with one end of shaft 44, and as shown in FIGS, 5 and 6, a suitable fastener 74 releasably maintains shaft 44 and member 60 in operable combination. Although fastener 74 is shown as a conventional elongated and threaded bolt passing through member 60 and shaft 44 and which is secured by a conventional nut, it should be appreciated other fasteners, i.e. an elongated headed pin held in place by a suitable clip, set screw or other types of fasteners would equally suffice without detracting or departing from the spirit and scope of the invention disclosure.

Figure 7:
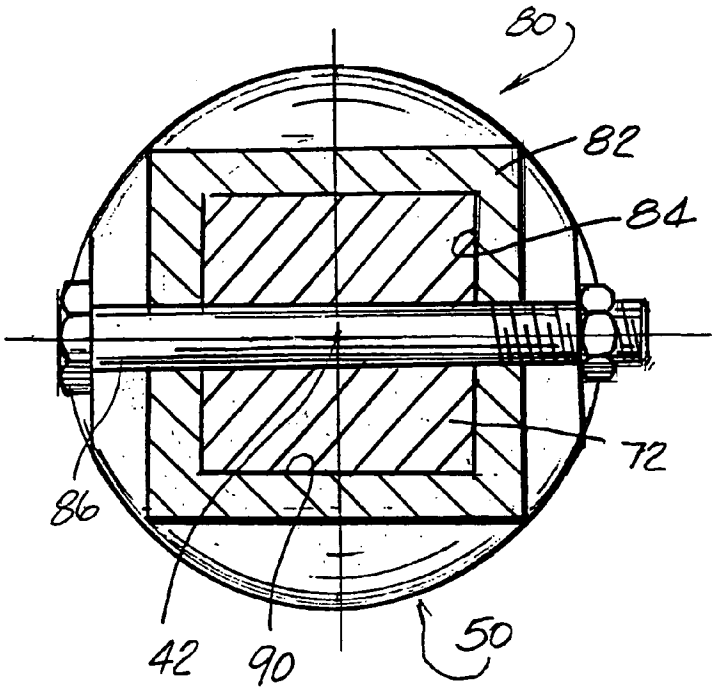
FIG. 7 is a sectional view taken along line 7-7 of FIG. 5.

As shown in FIGS. 4 and 7, the second end portion 72 of the first or driven member 60 has a non-circular cross-sectional configuration extending axially inward from a terminal end 75 (FIG. 4) of member 60. In the illustrated embodiment, the non-circular cross-sectional configuration of the second end portion 72 of the driven member 60 is shown, by way of example, as being square. Given an understanding of this invention disclosure, it will be appreciated that the non-circular cross-sectional configuration of the second end portion 72 of the driven member 60 could likewise be oval, rounded triangle, or spline (along the long axis of member 60) without detracting or departing from the spirt and scope of the invention disclosure.

As shown in FIGS. 4 and 5, the second or drive member 80 of each capstan assembly has first and second axially aligned ends 82 and 92, respectively. The end portion 82 of the drive member 80 of each capstan assembly operably serves as a releasable but rigid extension of driven member 60 and such that rotary or turning movements imparted to drive member 80 of each capstan are transferred to the first or driven member 60 and to the operating shaft assembly 44. Returning to that embodiment shown in FIG. 5, the end portion 82 of the second or drive member 80 is releasably coupled in non-rotatable relation relative to end portion 72 of the driven or first member 60.

In the illustrated embodiment, the drive or second member 80 of each capstan assembly defines a cavity or recess 84 opening to the end 82 of member 80 opposite from a free terminal, end 85 of member 80 so as to allow for axial reception and accommodation of the end portion 72 of the driven member 60. As shown in FIG. 7, recess 84 has a closed and non-circular marginal edge configuration 90 substantially similar to the non-circular cross-sectional configuration at and extending axially inward from the terminal end 75 of member 60. As will be appreciated from an understanding of this form of the invention disclosure, the closed and non-circular marginal edge 90 of cavity or recess 84 is configured to allow the end 72 of drive member 60 to be longitudinally received therewithin while preventing rotation or rotary movement between members 60 and 80 when the driven member 80 is turned or rotated about axis 42.

Because the non-circular cross-sectional configuration extending axially inward from the terminal end 75 of member 60 is illustrated, by way of example, as being generally square, the closed and non-circular marginal edge 90 of cavity or recess 84 is likewise shown by way of example as being generally square. Given an understanding of this invention disclosure, it should be appreciated that the closed and generally non-circular marginal edge configuration 90 of the recess 84 will generally correspond to the non-circular cross-sectional configuration provided for the end portion 72 of member 60 and vice versa.

After the driven and drive members 60 and 80, respectively, are arranged in axial assembled relation relative to each other, and as shown in FIGS, 5 and 7, a suitable fastener 86 releasably maintains the members 60, 80 of each capstan assembly in operable combination relative to each other. Although fastener 86 is shown as a conventional elongated and threaded bolt passing through the conjoined ends of members 60, 80, and which is secured by a conventional nut, it should be appreciated other fasteners, i.e. an elongated headed pin held in place by a suitable clip, set screw or other types of fasteners would equally suffice without detracting or departing from the spirit and scope of the invention disclosure.

The second end 92 of the drive member 80 is preferably configured with an enlarged head portion 94. As shown in FIG. 4, the head portion 94 of drive member 80 is provided with a plurality of surfaces 95*a* and 95*c* along with 95*b* and 95*d* flanking the fixed axis of rotation 42 of the operating shaft assembly 40. At least two of the surfaces 95*a*, 95*b*, 95*c* and 95*d* are releasably engaged by a mechanized driver 100 (FIG. 1) used to forcibly impart rotation to the operating shaft assembly 40 when the gate 28 (FIG. 1) is to be moved between positions.

As illustrated, head portion 94 of drive member 80 of each capstan assembly preferably defines a cavity or recess 95 arranged in axial alignment with the operating shaft assembly rotational axis 42 and opens to the free or terminal end 85 of the second or drive member 80. The cavity 95 has a closed and non-circular marginal edge configuration defined by surfaces 95*a*, 95*b*, 95*c* and 95*d* 4extending axially inward from the free or terminal end 85 of member 80. In the illustrated embodiment, cavity 95 is sized and shaped to releasably and axially accommodate a drive spindle 102 (FIG. 1) of the mechanized driver 100. Preferably, the closed and non-circular marginal edge configuration of recess 95 is generally square but other non-circular configurations would equally suffice without detracting or departing from the spirit and scope of the invention disclosure.

In the embodiment illustrated for exemplary purposes, the enlarged head portion 94 of drive member 80 also defines two pairs 97 and 97' of openings passing therethrough. Each opening in each pair of openings 97, 97' preferably has a closed marginal edge 98. Moreover, in the preferred embodiment, each pair of openings 97, 97' is disposed in generally normal relation relative to the other pair of openings 97, 97'. Furthermore, each pair of openings 97, 97' is disposed along an axis 99, 99' extending generally normal to the rotationally fixed axis 42 of the operating shaft assembly 40. In the preferred embodiment, each opening of each pair of openings is sized to releasably accommodate a conventional and well known elongated opening bar (not shown) used to manually rotate the operating shaft assembly 40 to open/close the gate 28.

The gate assembly 14 illustrated for exemplary purposes preferably uses a conventional rack and pinion arrangement 34 (FIGS. 2 and 3) for operably coupling the operating shaft assembly 40 to the gate 28. As such, and as shown in FIGS. 1 and 3, the operating shaft assembly 40 can further include a pair of substantially identical pinion gears 36 and 36' mounted in laterally spaced relation on and for rotation with the operating shaft 40.

The gate assembly 14 illustrated for exemplary purposes furthermore includes a lock assembly, generally identified in FIG. 1 by reference numeral 54, and which is operable in timed relation relative to movement of the gate 28 toward an open position. A fuller description of lock assembly 54 is provided in coassigned U.S. Pat. No. 5,829,359; the applicable portions of which are incorporated herein by reference.

For those railcar gate assemblies including a lock assembly 54 similar to that disclosed in U.S. Pat. No. 5,829,359, one capstan assembly and preferably both capstan assemblies arranged in operable combination with the operating shaft assembly 40 include a lock actuator 56 for allowing the lock assembly 54 to be operated in timed relation with movement of the gate 38 toward an open position. In the embodiment illustrated, the first or driven member 60 of each capstan assembly 50, 50' includes radial cam structure 58. The cam structure 58 radially projects outwardly from and is provided between the first and second ends 62, 72 of the first or driven member 60. As described in U.S. Pat. No. 5,829,359, the cam structure 58 on one or both of the capstan assemblies 50, 50' operably serves as the actuator 56 for lock assembly 54.

Having a railcar gate assembly operating shaft assembly wherein each capstan assembly 60, 80 at opposite ends of the operating shaft 44 is of multipiece construction offers numerous benefits over heretofore known operating shaft designs. First, the multipiece construction of each capstan assembly facilitates repair/replacement of only the worn portion of the capstan assembly rather than the entire capstan as was heretofore required. That is, and when the surfaces on the capstan assembly engaged by the mechanical opener 100 become worn thus requiring repair/replacement of the capstan, with the present invention disclosure, only that part of the capstan assembly which is actually worn needs to be replaced rather than the entire capstan. Thus, the multipiece design of the capstan assembly can be more economical than other capstans designs.

Second, the multipiece configuration of the capstan assembly taught by this invention disclosure allows the worn portion of the operating shaft assembly to be replaced within minimal time constraints and without involving or requiring skilled labor. That is, operably disconnecting the capstan assembly piece having those surfaces worn by the mechanized driver 100 is readily achieved simply by axially sliding and separating the worn member from the remainder of the capstan assembly. With the present invention disclosure, separation of the two members 60, 80 forming each capstan assembly is easily accomplished simply though undoing of the fastener 74 used to hold the two members 60, 80 in operable combination each other. As such, no special skills are required to affect timely repair/replacement of the worn portion of the capstan assembly. Additionally, the worn parts on each capstan assembly can be replaced without having to remove the car from active service.

Moreover, the multipiece design of the capstan assembly lends itself to forming or fabricating the two pieces 60, 80 comprising each capstan assembly from different materials. For example, the axially innermost piece or member 60 of each capstan assembly can be made from a suitable material, i.e., cast iron, so as to retain its wear toughness and lubricity. The multipiece design of the present invention, however, allows the axially outer member or piece 80 of each capstan assembly to be fabricated from a material which is more wear resistant than cast iron, i.e. an alloy steel or even titanium. As should be appreciated by those skilled in the art, casting the entire operating handle assembly in an alloy steel or titanium would be substantially impossible, given the handle deign mentioned above, or cost prohibitive to customers.

An operating shaft assembly for a railcar gate assembly which incorporates multipiece capstan assemblies furthermore allows for repair/replacement of the worn portion of the capstan while allowing the remainder of the operating shaft assembly to remain in timed relation with the gate. That is, with the present invention disclosure, only an end portion of each capstan assembly is required to be replaced without requiring disassembly of the entire operating shaft, including the pinion gears 36, 36', from operable drive association with the gate assembly 14. Accordingly, concerns over the pinion gears 36, 36' disengaging from the operating shaft 44 and thereafter having to reset and maintain an appropriate angular relationship between the operating shaft 44, pinion gears 36, 36', and gate position are eliminated.

From the foregoing, it will be observed that numerous modifications and variations can be made and effected without departing or detracting from the true spirit and novel concept of the present invention disclosure. Moreover, it will be appreciated, the present disclosure is intended to set forth an exemplification which is not intended to limit the invention disclosure to the specific embodiment illustrated. Rather, this disclosure is intended to cover by the appended claims all such modifications and variations as fall within the spirit and scope of the claims.

What is claimed is:

1. A railcar gate assembly multipiece operating shaft assembly mountable for rotation on a railcar gate assembly and operably coupled to a gate mounted on a gate assembly frame, said railcar gate assembly multipiece operating shaft assembly, comprising:

an elongated operating shaft; and a two-piece capstan assembly provided at each end of said operating shaft, each two-piece capstan assembly including a first member releasably coupled in non-rotatable relation relative to an end of said operating shaft and mountable on said gate assembly frame for rotation about a fixed axis, and with said first member having a first end portion disposed proximate to said gate assembly frame and an axially spaced second end portion; and wherein each two-piece capstan assembly further includes a second member having a first end portion releasably coupled in non-rotatable relation relative to the second end portion of said first member such that rotational movements imparted to said second member are transferred to said first member and to said operating shaft coupled thereto, with said second member having a free terminal end with an enlarged head portion defining an opening axially aligned with the fixed axis of rotation of said first member, with the opening defined by said head portion of said second member having a closed and non-circular marginal edge extending axially inward from a free terminal end of said second member for releasably accommodating a drive spindle of a mechanical opener.

2. The railcar gate assembly multipiece operating shaft assembly according to claim 1, wherein said operating shaft has a non-circular solid cross-sectional configuration extending substantially between opposed ends thereof.

3. The railcar gate assembly multipiece operating shaft assembly according to claim 2, wherein said first member is provided with a cavity axially aligned with the fixed axis of rotation of said first member, with said cavity opening to the first end portion of said first member opposite from said second end portion, and with said cavity having a closed and non-circular marginal edge configuration substantially similar to that of said operating shaft.

4. The railcar gate assembly multipiece operating shaft assembly according to claim 1, wherein a fastener releasably couples said first member and said operating shaft in operable combination relative to each other.

5. The railcar gate assembly multipiece operating shaft assembly according to claim 1, wherein said first member is provided with cam structure.

6. The railcar gate assembly multipiece operating shaft assembly according to claim 1, wherein said first member has a non-circular cross-sectional configuration extending axially inward from a terminal end of said first end portion.

7. The railcar gate assembly multipiece operating shaft assembly according to claim 6, wherein said second member is provided with a cavity opening to the first end portion of said second member opposite from said free terminal end, with the cavity defined by said second member having a closed and non-circular marginal edge configuration substantially similar to a non-circular cross-sectional configuration extending axially inward from the second end portion of said first member.

8. The railcar gate assembly multipiece operating shaft assembly according to claim 1, wherein the head portion on said second member defines two pairs of openings passing therethrough, with each pair of openings having a closed marginal edge and being disposed in generally normal relation relative to the other, and with each pair of openings being disposed along an axis extending generally normal to the fixed axis of rotation of said first member.

9. The railcar gate assembly multipiece operating shaft assembly according to claim 1, further including a pair of substantially identical pinion gears mounted on said operating shaft.

10. A railcar gate assembly multipiece operating shaft assembly mountable for rotation by frame members of a railcar gate frame assembly, said frame members of said gate assembly being laterally separated by a predetermined distance , and with said operating shaft assembly being operably coupled to a gate mounted on the frame assembly for movement between closed and open positions in response to rotation of said operating shaft assembly, said railcar gate assembly multipiece operating shaft assembly, comprising:

an elongated operating shaft having two ends, with a distance between said ends of said operating shaft being greater than the predetermined distance separating said frame members; and a capstan assembly provided at each end of said operating shaft, each capstan assembly including an axially elongated driven member having first and second axially aligned ends, with the first end of said driven member being releasably coupled in non-rotatable relation relative to one end of said operating shaft, and with said driven member being configured with a hub bearing portion arranged adjacent to the first end of said driven member for journaling said driven member on one of said frame members of said gate assembly for rotation about a fixed axis; with each capstan assembly further including an axially elongated drive member having first and second ends, with the first end of said drive member being configured to be releasably coupled in non-rotatable relation relative to the second end of said driven member such that rotational movements imparted to said drive member are transferred to said driven member and to said operating shaft coupled thereto, with the second end of said drive member being configured with an enlarged head portion defining a recess axially aligned with the fixed axis of rotation of and opening to the second end of said driven member, with said recess in said drive member having a non-circular and closed marginal edge extending axially inward from the second end of said drive member for releasably accommodating a drive spindle of a mechanical opener.

11. The railcar gate assembly multipiece operating shaft assembly according to claim 10, wherein said driven and drive members of each capstan assembly are formed as a result of a casting process.

12. The railcar gate assembly multipiece operating shaft assembly according to claim 10, wherein said operating shaft has a non-circular solid cross-sectional configuration extending substantially between the ends thereof.

13. The railcar gate assembly multipiece operating shaft assembly according to claim 12, wherein said driven member defines a blind cavity axially aligned with said fixed axis of rotation, with said blind cavity opening to the first end of said driven member, and with said blind cavity having a closed and non-circular marginal edge configuration substantially similar to that of said operating shaft.

14. The railcar gate assembly multipiece operating shaft assembly according to claim 10, wherein a fastener releasably maintains said driven member and said operating shaft in operable combination relative to each other.

15. The railcar gate assembly multipiece operating shaft assembly according to claim 10, wherein said driven member is provided with cam structure between the axially aligned ends thereof.

16. The railcar gate assembly multipiece operating shaft assembly according to claim 10, wherein said drive member has a non-circular cross-sectional configuration extending axially inward from the second end thereof.

17. The railcar gate assembly multipiece operating shaft assembly according to claim 16, wherein said drive member defines a blind cavity opening to the first end thereof, with the blind cavity defined by said drive member having a closed and non-circular marginal edge configuration substantially similar to the non-circular cross-sectional configuration extending axially inward from the second end of said driven member.

18. The railcar gate assembly multipiece operating shaft assembly according to claim 10, wherein the head portion on said driven member defines two pairs of aligned openings passing therethrough, with each pair of openings being disposed in generally normal relation relative to the other, and with each pair of openings being disposed along an axis extending generally normal to said fixed axis of rotation.

19. The railcar gate assembly multipiece operating shaft assembly according to claim 10, further including a pair of substantially identical pinion gears mounted on said operating shaft.

20. A railcar gate assembly multipiece operating shaft assembly mountable for rotation about a fixed axis on a railcar gate assembly and operably coupled to a gate mounted on a frame for movement between closed and open positions in response to rotation of said operating shaft assembly, said railcar gate assembly multipiece operating shaft assembly, comprising:

an elongated operating shaft having longitudinally spaced ends; and a capstan assembly provided at each end of said operating shaft, each capstan assembly including a first and a second axially aligned and conjoined but separate members, with said first member being releasably coupled in non-rotatable relation relative to one end of said operating shaft and mountable on said gate assembly frame to define a fixed axis of rotation of said operating shaft assembly; and with the second member of each capstan assembly being releasably conjoined in non-rotatable relation relative to said first member such that rotational movements imparted to said second member are transferred to said first member and to said operating shaft coupled thereto, with said second member having a free end portion configured with a plurality of surfaces flanking the fixed axis of rotation of said operating shaft assembly and at least two of which are releasably engaged by a mechanized device used to forcibly impart rotation to said operating shaft assembly.

21. The railcar gate assembly multipiece operating shaft assembly according to claim 20, wherein the second member defines a blind cavity opening to one end of said second member and axially aligned with the fixed axis of rotation of said operating shaft assembly, and wherein the blind cavity defined at the one end of said second member has a closed non-circular marginal edge including said at least two surfaces releasably engaged by said mechanized device.

22. The railcar gate assembly multipiece operating shaft assembly according to claim 20, wherein said operating shaft has a non-circular solid cross-sectional configuration extending substantially between the ends thereof.

23. The railcar gate assembly multipiece operating shaft assembly according to claim 22, wherein said first member is provided with a recess axially aligned with the fixed axis of rotation of said operating shaft assembly, with said recess opening to one end of said first member, and with said recess having a closed and non-circular marginal edge configuration substantially similar to that of said operating shaft.

24. The railcar gate assembly multipiece operating shaft assembly according to claim 20, wherein a fastener releasably maintains said first member and said operating shaft in operable combination relative to each other.

25. The railcar gate assembly multipiece operating shaft assembly according to claim 20, wherein said first member has a non-circular cross-sectional configuration extending axially inward from one end thereof.

26. The railcar gate assembly multipiece operating shaft assembly according to claim 25, wherein said second member is provided with a recess opening to an end of said second member opposite from said free end, with the recess defined by said second member having a closed and non-circular marginal edge configuration substantially similar to that non-circular cross-sectional configuration extending axially inward from the one end of said first member.

27. The railcar gate assembly multipiece operating shaft assembly according to claim 20, wherein said second member defines, toward the free end portion of said second member, two pairs of aligned openings passing therethrough, with each pair of openings being disposed in generally normal relation relative to the other, and with each pair of openings being disposed along an axis extending generally normal to the fixed axis of rotation of said operating shaft assembly.

28. The railcar gate assembly multipiece operating shaft assembly according to claim 20, further including a pair of substantially identical pinion gears mounted on said operating shaft.

29. A capstan for an operating shaft assembly of a railcar gate assembly, wherein said operating shaft assembly includes an elongated operating shaft arranged on a gate assembly frame, and wherein said capstan includes an axially elongated first member configured to be coupled in non-rotatable relation relative to an end of said operating shaft and defining an elongated axis, and with said first member having first and second end portions, with said first end portion being adapted to be releasably coupled to said elongated operating shaft; and wherein each capstan further includes an axially elongated second member releasably coupled in non-rotatable relation relative to the second end portion of said first member, with said second member defining an elongated axis which, when said first and second members are operably coupled to each other, aligns with the elongated axis of said first member, with said second member having a free end with an enlarged head portion, and wherein the free end of said second member is configured with a plurality of surfaces flanking the elongated axis of said second member and at least two of which are releasably engaged by a mechanized device used to forcibly impart rotation to said operating shaft assembly.

* * * * *